US006209837B1

(12) United States Patent
Harms

(10) Patent No.: US 6,209,837 B1
(45) Date of Patent: Apr. 3, 2001

(54) VERTICAL BALUSTER BRACKET

(76) Inventor: Stephen J. Harms, 610 Lima Center Rd., Chelsea, MI (US) 48118

( * ) Notice: Subject to any disclaimer, the term of this patent is extended or adjusted under 35 U.S.C. 154(b) by 0 days.

(21) Appl. No.: 09/093,101

(22) Filed: Jun. 8, 1998

Related U.S. Application Data

(60) Provisional application No. 60/049,147, filed on Jun. 10, 1997.

(51) Int. Cl.[7] ..... A47H 1/16

(52) U.S. Cl. ..... 248/302; 248/210; 248/213.2

(58) Field of Search ..... 248/302, 303, 248/218.4, 249, 340, 213.2, 210

(56) References Cited

U.S. PATENT DOCUMENTS

| | | | | |
|---|---|---|---|---|
| 386,228 | * | 7/1888 | Allen | 248/302 |
| 490,224 | * | 1/1893 | Campbell | 248/302 |
| 562,907 | * | 6/1896 | Neider | 248/303 |
| 982,604 | * | 1/1911 | Herring | 248/302 |
| 1,007,843 | * | 11/1911 | Botsford | 248/302 |
| 1,388,799 | * | 8/1921 | Christensen | 248/302 |
| 1,487,336 | * | 3/1924 | Kamp | 248/303 |
| 1,728,613 | * | 9/1929 | Jones | 248/302 |
| 1,785,061 | * | 12/1930 | White | 248/303 |
| 1,942,893 | * | 1/1934 | Harris | 248/303 |
| 2,485,288 | * | 10/1949 | Homann | 248/303 |
| 3,203,658 | * | 8/1965 | Brown | 248/303 |
| 3,220,682 | * | 11/1965 | Hannon | 248/303 |
| 3,226,072 | * | 12/1965 | Johnson | 248/302 |
| 3,272,467 | * | 9/1966 | Kassube | 248/303 |
| 3,559,939 | * | 2/1971 | Luna | 248/302 |
| 3,669,394 | * | 6/1972 | Loucks | 248/221 |
| 4,015,809 | * | 4/1977 | Buril | 248/217.2 |
| 4,232,847 | * | 11/1980 | Cooper | 248/302 |
| 4,809,941 | * | 3/1989 | Sheridan | 248/302 |
| 5,476,240 | * | 12/1995 | McDonough | 248/303 |
| 5,916,028 | * | 6/1999 | Downer et al. | 47/46 |

* cited by examiner

*Primary Examiner*—Anita M. King
(74) *Attorney, Agent, or Firm*—James M. Deimen

(57) ABSTRACT

A new bracket comprises a single piece of rod bent at the outboard end to provide a device for hanging a flower pot or other item. At the inboard or baluster end the rod is shaped by a series of four perpendicular bends. The length of the rod between the first and second bends and the length of the rod between the third and fourth bends are substantially the same and determined by the width of the baluster transverse to the bracket. The length of the rod between the second and third bends is determined by both the thickness of the baluster and the angle of the bracket relative to the vertical direction of the baluster. To remain in position the bracket relies upon friction with the baluster in combination with the weight of the bracket and load on the bracket outboard end.

12 Claims, 2 Drawing Sheets

10
16
14
18
12
LOCK
22
26
F
34
30
LOCK 14
10
12
22
20
24

26
34
28
32
30

VERTICAL BALUSTER BRACKET

This application is based on provisional patent application Ser. No. 60/049,147, filed Jun. 10, 1997.

BACKGROUND OF THE INVENTION

The field of the invention pertains to brackets for hanging potted plants and other decorative items and, in particular, to brackets of simple construction that may be installed without fasteners.

Brackets for supporting or hanging plants and other items normally require mechanical fasteners or adhesive for attachment to walls and vertical posts. Such fasteners leave unsightly holes or spots when removed, necessitating refinishing to remove the unsightly remnants.

Where the brackets are to be used temporarily or frequently moved, mechanical and adhesive fasteners present a particular problem because of the damage. Therefore, brackets with mechanical or adhesive fasteners may be completely unsuitable for temporary use. The vertical balusters on outdoor decks are typically left unfinished or may be painted or stained. Hanging plants are particularly attractive on such decks, therefore brackets that can be temporarily attached to such balusters without damage would be advantageous. Such a baluster bracket is described below.

SUMMARY OF THE INVENTION

The new bracket comprises a single piece of rod bent at the outboard end to provide a device for hanging a flower pot or other item. At the inboard or baluster end the rod is shaped by a series of four perpendicular bends. The length of the rod between the first and second bends and the length of the rod between the third and fourth bends are substantially the same and determined by the width of the baluster transverse to the bracket. The length of the rod between the second and third bends is determined by both the thickness of the baluster and the angle of the bracket relative to the vertical direction of the baluster. The length of the rod from the fourth bend to the end of the rod need only be sufficient to prevent tilting of the bracket when installed on the baluster.

To remain in position the bracket relies upon friction with the baluster in combination with the weight of the bracket and load on the bracket outboard end.

DESCRIPTION OF THE PREFERRED EMBODIMENT

Figure 1:
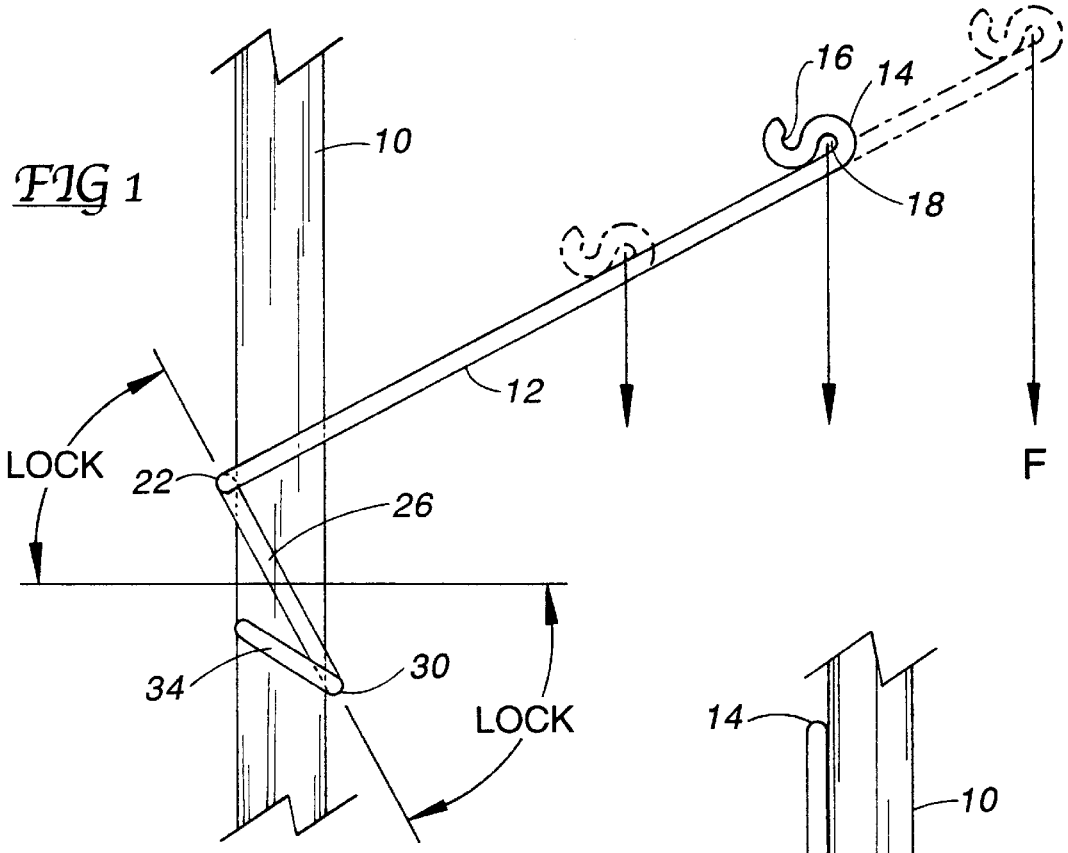
FIG. 1 is a side view of the new bracket with the baluster in ghost view.
Figure 2:
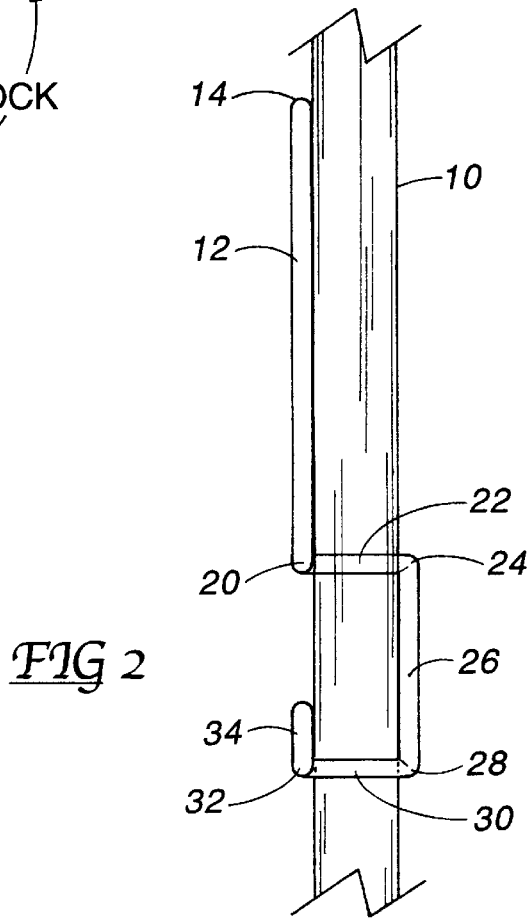
FIG. 2 is a front elevation of the new bracket with the baluster in ghost view.

FIGS. 1 and 2 illustrate a baluster 10 shown broken away and ghosted. Placed on the baluster is the new bracket having an arm 12 with the outboard end 14 formed into an open loop 16 and closed eye 18. Any suitable attachment configuration may be formed at the outboard end 14 depending on the item to be supported.

The bracket arm 12 extends beyond the baluster 10 to a first bend 20. Beyond the bend 20 is a transverse portion 22 of the rod perpendicular to the arm 12. A second bend 24 terminates the transverse portion 22. Beyond the second bend 24 is a short lever arm 26 that is perpendicular to both the transverse portion 22 and the arm 12.

A third bend 28 terminates the short lever arm 26 and a second transverse portion 30 extends from the third bend 28 in a direction perpendicular to the short lever arm 26. As is clear from FIG. 1, the transverse portions 22 and 30 engage the back and front of the baluster 10. To prevent the bracket from tilting on the baluster 10, the rod includes a fourth bend 32 and a locking arm 34.

The length of the transverse portions 22 and 30 is generally determined by the transverse width of the baluster 10. The length of the short lever arm 26 is determined by a combination of the expected load at the outboard end 14 of the arm 12, the frictional engagement of the transverse portions 22 and 30 with the baluster and thickness of the baluster. The frictional engagement includes the cross-sectional shape of the rod and the materials from which the bracket and baluster are made.

Figure 3:
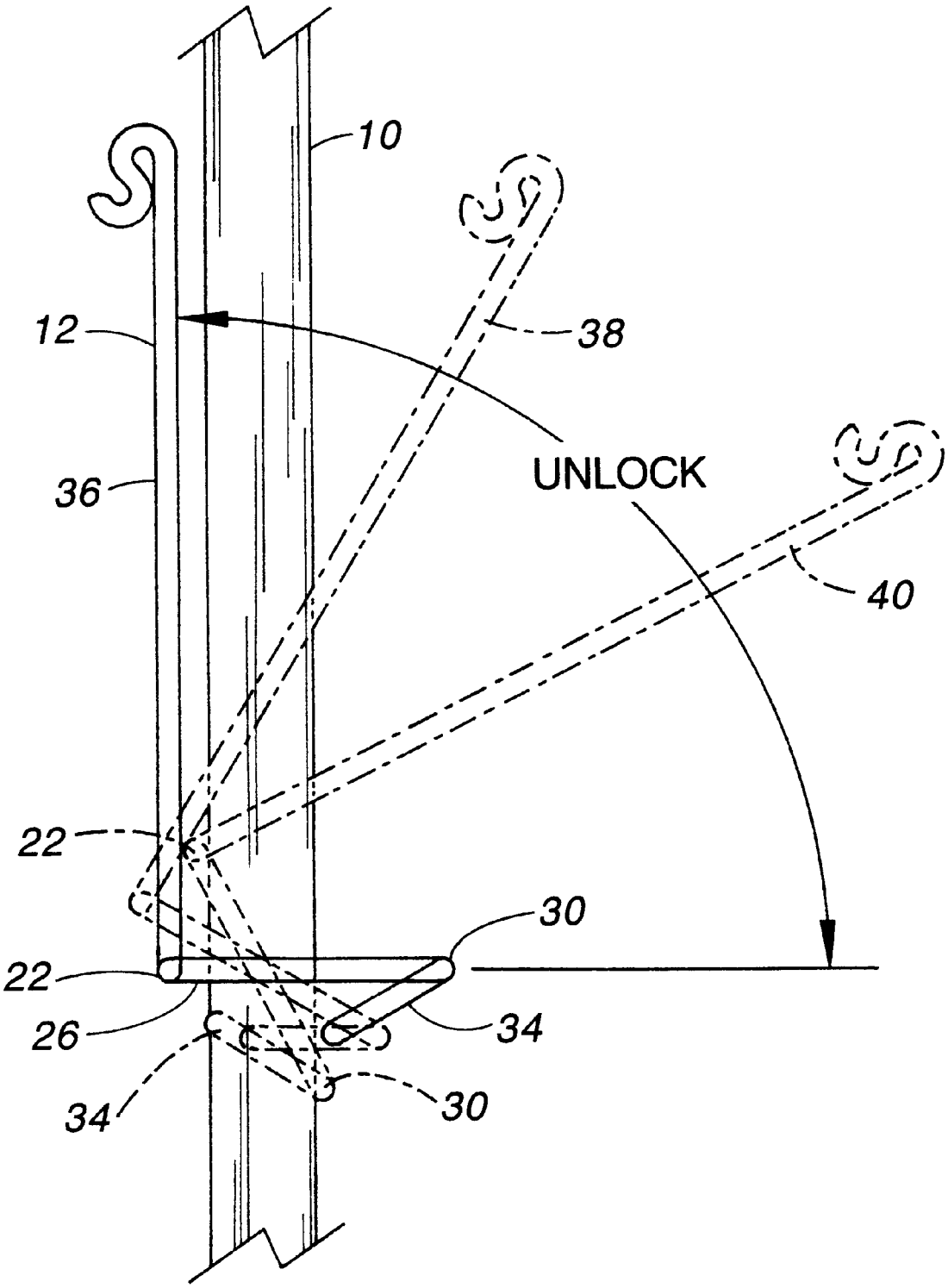
FIG. 3 is a side view showing the sequence of movement to install or remove the bracket from a baluster.

Illustrated in FIG. 3 is the method by which the bracket is installed on or removed from a baluster. The bracket is initially placed with the arm 12 vertical and the short lever arm 26 against the side of the baluster 10 as shown in solid outline 36. The short lever arm 26 must extend a sufficient distance beyond the locking arm 34 to permit the arm 12 and locking arm 34 to clear the baluster 10. As shown ghosted, the arm 12 can then be titled down 38 until the arm 12 reaches the position at 40 where the transverse portions 22 and 30 engage the back and front of the baluster 10.

I claim:

1. An integral baluster bracket comprising a relatively long cantilever arm adapted to support a load at an end position horizontally spaced from a baluster, said long cantilever arm diagonally extending from the baluster when mounted on a baluster, a first transverse portion extending at an angle from another end of the long cantilever arm, a short arm extending at an angle from the first transverse portion, a second transverse portion extending at an angle from the short arm, a locking arm extending at an angle from the second transverse portion, wherein the long arm, short arm and the transverse portions are adapted to surround three sides of a baluster and the locking arm is adapted to engage a fourth side of the baluster, the weight of the long cantilever arm and any load thereon causing the bracket to bind to the baluster.

2. The baluster bracket of claim 1 wherein each of the angles comprises a perpendicular angle.

3. The baluster bracket of claim 1 wherein at least one of the angles comprises a perpendicular angle.

4. The baluster bracket of claim 1 wherein the short arm is perpendicular to the long arm.

5. An integral baluster bracket comprising a relatively long cantilever arm adapted to support a load outboardly spaced from a baluster, said long cantilever arm diagonally extending from the baluster when mounted on a baluster.

a first transverse portion extending at an angle from an inboard end of the long cantilever arm, a short arm extending at an angle from the first transverse portion, a second transverse portion extending at an angle from the short arm, and a locking arm extending at an angle from the second transverse portion, wherein the transverse portions are engageable with opposite sides of a baluster, the weight of the long cantilever arm and any load thereon causing the bracket to bind to the baluster.

6. The baluster bracket of claim 5 wherein the short arm is perpendicular to the long arm.

7. The baluster bracket of claim 5 wherein at least one of the angles comprises a perpendicular angle.

8. The baluster bracket of claim 5 wherein each of the angles comprises a perpendicular angle.

9. The baluster bracket of claim 5 wherein the first and second transverse portions are parallel and perpendicular to the short arm.

10. The baluster bracket of claim 5 wherein the locking arm is substantially shorter than the short arm.

11. A combination baluster with ends and opposite sides and a bracket, the baluster intended for substantially vertical installation and the bracket installed on the baluster at a location intermediate the ends of the baluster, the bracket comprising a relatively long cantilever arm having two ends and adapted to support a load at one end position horizontally spaced from the baluster, a first transverse portion extending at an angle from another end of the long cantilever arm, a short arm extending at an angle from the first transverse portion, a second transverse portion extending at an angle from the short arm, and a locking arm extending at an angle from the second transverse portion, wherein the transverse portions are engageable with opposite sides of the baluster.

12. The baluster and bracket combination of claim 11 wherein the long cantilever arm, short arm and the transverse portions are adapted to surround four sides of the baluster and the locking arm is adapted to engage a side of the baluster.

* * * * *